US005290750A

United States Patent [19]

Kushi et al.

[11] Patent Number: 5,290,750

[45] Date of Patent: Mar. 1, 1994

[54] RECORDING MEDIA FOR A SUBLIMATION-TYPE HEAT-SENSITIVE RECORDING PROCESS

[75] Inventors: Kenji Kushi; Takayuki Iseki; Tadayuki Fujiwara; Kazuhiko Jufuku, all of Otake, Japan

[73] Assignee: Mitsubishi Rayon Co., Ltd., Tokyo, Japan

[21] Appl. No.: 919,645

[22] Filed: Jul. 27, 1992

[30] Foreign Application Priority Data

Jul. 26, 1991 [JP] Japan ..... 3-187832
Jul. 26, 1991 [JP] Japan ..... 3-187833
Jul. 26, 1991 [JP] Japan ..... 3-187834

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 913, 428/914, 480; 503/227

[56] References Cited

U.S. PATENT DOCUMENTS 4,965,240 10/1990 Imoto ..... 503/227

FOREIGN PATENT DOCUMENTS 0424037 4/1991 European Pat. Off. .
61-106293 5/1986 Japan .
61-237693 10/1986 Japan .
63-67189 3/1988 Japan .
64-42285 2/1989 Japan .

OTHER PUBLICATIONS

Translated Excerpt from "Theory and Practice for Plastic Compounding Ingredients", published by Eiichi Asayama, Plastic Age Co., Ltd., 1971.

*Primary Examiner*—B. Hamilton Hess
*Attorney, Agent, or Firm*—Oblon, Spivak, McClelland, Maier & Neustadt

[57] ABSTRACT

Disclosed is a recording media for a sublimation-type heat-sensitive transfer recording process. The purpose of the present invention is to supply a recording media for a sublimation-type heat-sensitive process possessing an extremely high whiteness degree. The recording media comprises an image receiving layer composed of a dyeable resin which can be dyed by a sublimable dye; a crosslinking agent; and an anthraquinone based bluing agent. With the recording media for a sublimation type heat-sensitive recording process according to the present invention, a recording media having a high whiteness degree which does not turn yellow following curing can be obtained. As a result of the high whiteness degree of the foundation, this recording media is of an extremely high grade, and due to its extremely vivid recording image, it will be widely adopted and marketed in video printers.

6 Claims, No Drawings

RECORDING MEDIA FOR A SUBLIMATION-TYPE HEAT-SENSITIVE RECORDING PROCESS

BACKGROUND OF THE INVENTION

1. Field of the Invention

The present invention relates to a recording media for use in a recording media for a sublimation-type heat-sensitive transfer recording process, in particular for increasing the whiteness degree therein.

2. Description of the Related Art

A sublimation-type heat sensitive transfer recording process is characterized by a low noise output, small-sized, low priced apparatus having a short output time and which is easily conserved. In addition, as a result of using a sublimable type disperse dye, high gradation recording characterized by such qualities as a high density and a high definition can be carried out by means of continual fluctuation of the heat generating energy amount. As a result in comparison with other recording processes, it is particularly advantageous in obtaining blue color copies. Accordingly, it is widely employed as the recording process in color printers, video printers, and the like.

As the image-receiving layer of the recording media for use in sublimation-type heat-sensitive transfer recording processes, a dyeable resin composed principally of a polyester resin which is thermally cured using a reactive silicon, as disclosed in Japanese Patent Application Kokai 61-106293, and a dyeable resin also composed mainly of a polyester resin which is cured by means of a crosslinking agent cured with active energy rays, as disclosed in Japanese Patent Application Kokai 63-67189, have been employed.

Recently, there has been wide adoption of video printers for public use on the market along with a user demand for image receiving paper with a high foundation whiteness degree in comparison with photo prints. As a means for increasing the whiteness degree of the recording media, a process is known, as disclosed in Japanese Patent Application Kokai 61-237693, in which white pigments such as titanium oxide and the like in the image-receiving layer are refined, and in which the addition of fluorescent whitening agents to the image-receiving layer is carried out.

However, in this process, as a result of introducing the white pigment inorganic particles into the image-receiving layer, minute projections and indentations are formed on the image-receiving layer surface upon curing, which in turn exert harmful effects on the recording image. For example, although an outlined image is provided, there exist problems in that it is difficult to uniformly disperse the white pigment on the image-receiving layer coat. In addition, in the case when using a fluorescent whitening agent, the existence stability of the image-receiving layer becomes damaged by addition of the fluorescent whitening agent, namely, the image-receiving layer turns yellow from the light and heat. Furthermore, there exists a drawback in that due to the comparatively high cost of the fluorescent whitening agent, its addition results in a similar increase in the cost of the image-receiving paper. Similarly, in the case when curing the image-receiving layer with active energy rays, due to the powerful energy, there exists a problem in that the image-receiving layer turns yellow following changing of the white pigment to a yellow color and decomposition of the fluorescent whitening agent.

SUMMARY OF THE INVENTION

The purpose of the present invention is to improve the drawbacks of the aforementioned related art and supply a recording media for a sublimation type heat-sensitive process possessing an extremely high whiteness degree.

By means of employing an image receiving layer composed of a dyeable resin which is able to be colored by a sublimable dye; a crosslinking agent; and an anthraquinone based bluing agent; existing problems can be solved.

With the recording media for a sublimation-type heat-sensitive recording process according to the present invention, a recording media having a high whiteness degree which does not turn yellow following curing can be obtained. As a result of the high whiteness degree of the foundation, this recording media is of an extremely high grade, and due to its extremely vivid recording image, it will be widely adopted and marketed in video printers.

DESCRIPTION OF THE PREFERRED EMBODIMENTS

In the following the present invention will be described in detail.

As specific examples of the dyeable resin there can be mentioned polyester resins, poly(meth)acrylate ester resins, polycarbonate resins, polyvinyl acetate resins, styrene-acrylate copolymer resins, vinyl toluene-acrylate copolymer resins, polyurethane resins, polyamide resins, urea resins, polycaprolactone resins, styrene maleic anhydride copolymer resins, polyvinyl chloride resins and polyacrylonitrile resins. These resins can be used singly, or in the form of mixtures or copolymers.

The amount of the dyeable resin incorportated is 40 to 95% by weight, preferably 55 to 94% by weight, based on the total amount of the dyeable resin and the crosslinking agent. If the amount of the dyeable resin is less than 40% by weight, the density of the color provided by the sublimable disperse dye is low under low energy conditions. On the other hand, if the amount of the dyeable resin exceeds 95% by weight, the amount of the crosslinking resin is reduced, and the non-blocking property to a color sheet (transfer paper) coated with the sublimable disperse dye becomes poor and blocking (i.e., sticking) of the recording media to the color sheet caused at the heat transfer step.

Among the aforementioned dyeable resin, polyester resin is preferred to be used at least as a component in the dyeable resin since polyester resins can be easily dyed by the sublimable dye, and the existence stability of the image obtained thereon is good.

As the polyester resin, there can be mentioned linear thermoplastic polyester resins obtained by polycondensation between a dicarboxylic acid and a diol, and/or unsaturated polyester resins obtained by polycondensation between an unsaturated polybasic acid having a reactive double bond and a polyhydric alcohol. In view of the solubility in an organic solvent, the dyeing ease and the light resistance, a linear thermoplastic polyester resin having a molecular weight of 2,000 to 40,000 and a crystallization degree of not higher than 1%, which is obtained by polycondensation between at least one dicarboxylic acid and at least one diol, is especially preferred.

As specific examples of the linear thermoplastic polyester resin obtained by polycondensation between at least one dicarboxylic acid and at least one diol, there can be mentioned a polyester resin obtained from terephthalic acid, isophthalic acid, ethylene glycol and neopentyl glycol, a polyester resin obtained from terephthalic acid, sebatic acid, ethylene glycol, and neopentyl glycol, and a polyester resin obtained from terephthalic acid, isophthalic acid, ethylene glycol and a bisphenol A/ethylene oxide adduct, a polyester resin obtained from terephthalic acid, isophthalic acid, ethylene glycol and 1,6 hexanediol, a polyester resin obtained from terephthalic acid, isophthalic acid, sebacic acid, ethylene glycol, and neopentyl glycol, and a polyester resin obtained from terephthalic acid, isophthalic acid, adipic acid, ethylene glycol and neopentyl glycol. These polyester resins can be used singly, or in the form of mixtures of two or more thereof. In order to improve the stability against light, heat, water or others, preferably two or more of these polyester resins are used in combination. For example, when two polyesters A and B are used, preferably the A/B weight ratio is from 20/80 to 80/20.

As specific examples of the crosslinking agent, in the case of thermosetting, there can be mentioned reactive setting silicon oils such as cured amino denatured silicon oils and epoxy denatured silicon oils. In the case of lightsetting, there can be mentioned polyfunctional monomers or polyfunctional oligomers possessing light setting silicon oils and (meth)acryloyloxy groups, however, more preferred are polyfunctional monomers or polyfunctional oligomers possessing (meth)acryloyloxy groups. Ultraviolet rays that can be easily handled as the active energy rays can be used for these agents, and these agents can be set in a short time period, thus are advantageous from a productivity standpoint.

As specific examples of the monomer or oligomer, there can be mentioned polyether (meth)acrylates such as those synthesized from 1,2,6-hexanetriol, propylene oxide and acrylic acid and from trimethylolpropane, propylene oxide and acrylic acid; polyester (meth)acrylates such as those synthesized from adipic acid, 1,6-hexanediol and acrylic acid and from succinic acid, trimethylolethane and acrylic acid; (meth)acrylates or polyol (meth)acrylates such as triethylene glycol diacrylate, hexapropylene glycol diacrylate, neopentyl glycol diacrylate, 1,4-butane diol dimethacrylate, 2-ethylhexyl acrylate, tetrahydrofurfuryl acrylate, 2 hydroxyethyl methacrylate, ethylcarbitol acrylate, trimethylolpropane triacrylate, pentaerythritol tetra-acrylate, dipentaerythritol tetra-acrylate, dipentaerythritol penta-acrylate, 2,2-bis(4-acryloyloxydiethoxyphenyl)propane, and 2,2-bis(4-acryloyloxydipropoxyphenyl)propane; epoxy (meth)acrylates such as those synthesized from diglycidyl-etherified bisphenol A and acrylic acid, from diglycidyl-etherified polybisphenol A and acrylic acid, and from triglycidyletherified glycerol and acrylic acid; amideurethane (meth)acrylates such as those synthesized from γ-butyrolactone, N-methylethanolamine, bis(4-isocyanatocyclohexyl)methane and 2-hydroxyethyl acrylate, and from γ-butyrolactone, N-methylethanolamine, 2,6-tolylenediisocyanate, tetraethylene glycol and 2-hydroxyethyl acrylate; urethane acrylates such as 2,6-tolyenediisocyanate diacrylate, isophorone diisocyanate diacrylate, and hexamethylenediisocyanate diacrylate; spiroacetal acrylates such as those synthesized from diallylidene pentaerythritol and 2-hydroxyethyl acrylate; and acrylated polybutadienes such as those synthesized from epoxidized butadiene and 2-hydroxyethyl acrylate. These monomer and oligomers may be used singly or in the form of mixture of two or more thereof.

Of the above-mentioned monomers and oligomers, compounds represented by the following general formulae (3),(4) and (5) are especially preferred as the crosslinking agent because they have an excellent quick-drying property in air when ultraviolet rays are used as the active energy rays.

Compounds represented by the following general formula (3):

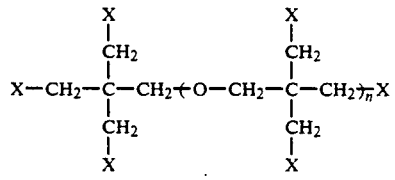

(3)

(in which n is an integer from 1 to 4, at least three of the groups X are groups represented by the general formula $CH_2{=}CH{-}COO{-}R_8{-}$(in which $R_8$ represents single bond, an alkylene group having 1 to 8 carbons or a polyoxyalkylene group having an alkylene group having 1 to 8 carbon atoms), and the remaining groups X are selected from an alkyl group having 1 to 8 carbon atoms, a hydroxyl group, an amino group, a group represented by the formula $-(OR_9)m-H$ (in which $R_9$ represents an alkylene group having 1 to 8 carbon atoms and m is positive integer) or a group represented by the formula$-(OR_9)_m-OH$ (in which $R_9$ and m are as defined above), or a group represented by the formula$-(OCOR_9)_m-H$ (in which $R_9$ and m are as defined above).

As specific examples of this type of compound, there can be mentioned dipentaerythritol tetra-acrylate, dipentaerythritol penta-acrylate, dipentaerythritol hexaacrylate, tripentaerythritol penta-acrylate, tripentaerythritol hexa-acrylate and tripentaerythritol hepta-acrylate.

Polybisphenol A polyacrylates represented by the following general formula (4):

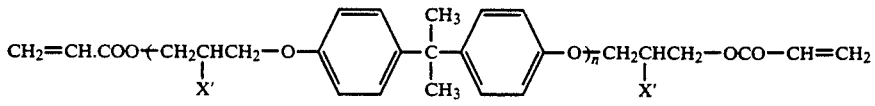

(4)

(wherein n is a positive integer from 1 to 10 and X' is optionally —OH or $-OCOCH{=}CH_2$). As specific examples of this type of compound, there can be mentioned diglycidyletherified bisphenol A diacrylate and a diacrylate of Epikote #1001 (n=3, supplied by Yuka-Shell Epoxy Co., Ltd).

Compounds represented by the following general formula (5):

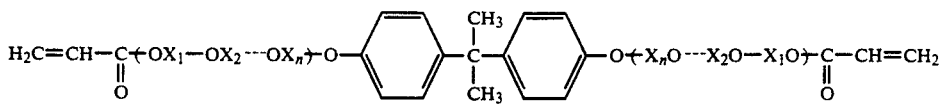

(5)

(wherein $X_1$, $X_2$, . . . and $X_n$, which may be the same or (wherein X:, different, represent an alkylene group having up to 6 carbon atoms, in which one hydrogen atom may be substituted by a hydroxyl group, and n is an integer from 0 to 5). As specific examples of this type of compound, there can be mentioned 2,2-bis(4-acryloyloxydiethoxyphenyl)propane and 2,2-bis(4-acryloyloxydipropoxyphenyl)propane.

Additionally, in the present invention in order to further improve the anti-blocking property between the recording media and the transfer sheet (anti-sticking property), it is preferred that a releasing agent be incorporated into the image receiving layer. As the releasing agent to be used, there can be mentioned silicon-containing surface active agents, fluorine-containing surface active agents, graft polymers with polyorganosiloxane in the main stem or in a branch, and silicon or fluorine-containing compounds which are crosslinkable.

These releasing agents can be used singly or at the same time. The amount of releasing agent incorporated is 0.01 to 30 parts by weight, preferably 0.05 to 10 parts by weight, per 100 parts by weight of the total amount of the dyeable resin and the crosslinking agent.

Among the silicon-containing surface active agents, a polydimethylsiloxane/polyoxyalkylene block compound (which may be modified with another functional group) in which the ratio of the group $CH_3$—$(SiO)_{\frac{1}{2}}$— to the group —OR— (in which R represents an alkylene residue) is from 1/10 to 1/0.1, preferably from 1/5 to 1/0.2, is effective in improving the anti blocking property, leveling property and dyeing density.

As specific examples of the silicon-containing surface active agent, there can be mentioned compounds represented by the following general formulae (6) and (8):

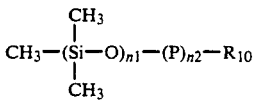

(6)

(wherein P is represented by general formula (7):

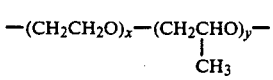

(7)

and $n_1$ and $n_2$ represent a positive integer, x and y represent 0 or a positive integer, with the proviso that $n_1$, $n_2$, x and y satisfy the requirement of $$1/10 \leqq (2n_1+)/(n_2x+n_2y) \leqq 10,$$

and $R_{10}$ represents a hydrogen, an alkyl group, an acyl group or an aryl group.)

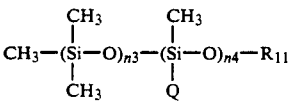

(8)

(wherein Q is represented by the following general formula (9):

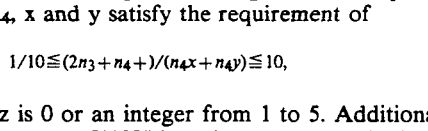

(9)

wherein $n_3$ and $n_4$ represent a positive integer, x and y represent 0 or a positive integer, with the proviso that $n_3$, $n_4$, x and y satisfy the requirement of $$1/10 \leqq (2n_3+n_4+)/(n_4x+n_4y) \leqq 10,$$

and z is 0 or an integer from 1 to 5. Additionally, $R_{11}$ represents —$Si(CH_3)_3$, a hydrogen, an alkyl group, an acyl group or an aryl group, and $R_{12}$ represents a hydrogen, an alkyl group, an acyl group or an aryl group.)

One or more members selected from non-ionic, anionic, cationic, or amphoteric fluorine containing surface active agents which are soluble to some extent in the mixture of the dyeable resin and the crosslinking agent can be used as the fluorine-containing surface active agent. In order to improve the leveling and anti-blocking properties, the use of non-ionic surface active agents is preferred.

As specific examples of the fluorine-containing surface active agent, there can be mentioned anionic surface active agents such as fluoroalkoxypolyfluoroalkyl sulfates, fluorocarbon-sulfonic acid salts and fluorocarbon-carboxylic acid salts; cationic surface active agents such as N-fluoroalkylsulfonamide alkylamine quaternary ammonium salts, N-fluoroalkylcarbonicamide alkylamine salts, N-fluoroalkylamide alkylamine quaternary ammonium salts, N-fluoroalkylamide alkylamine salts and N-fluoroalkylsulfonamide alkylhalomethyl ether quaternary ammonium salts; non-ionic surface active agents such as fluorocarbon sulfonamides, fluorocarbon aminosulfonamides, fluorocarbon carboxysulfonamides, fluorocarbon hydroxysulfonamides, fluorocarbon sulfonamide/ethylene oxide adducts, fluorocarbon hydroxysulfonamide sulfates, fluorocarbon amino acid amides, fluorocarboxylic acid amides, fluorocarbon hydroxy-acid amides, fluorocarbon acid amide-/ethylene oxide addition condensates, fluorocarbon hydroxy-acid amide sulfates, fluorocarbon sulfonic acids, fluorohydrocarbon carboxylic acids, fluorohydrocarbon alkyl esters, fluorohydrocarbon alkyl ethers, fluorohydrocarbon carboxyalkyl esters, fluorohydrocarbon hydroxyamides, fluorohydrocarbon alkyl sulfates and fluoroalkyldiamines; and amphoteric surface active agents such as alkylamines having a betaine type fluorocarbon sulfonamide linkage and alkylamines having a betaine type fluorocarbon acid amide linkage.

As the graft polymer possessing polyorganosiloxane in the main stem or in a branch, there can be mentioned graft polymers having in the main stem polymers or copolymers obtained from vinyl polymerization, condensation polymerization, ring-opening polymerization, and the like, and polyorganosiloxane in a branch. As specific examples of these graft polymers there can be mentioned, graft polymers obtained from the polymerization of polysiloxane (macromonomer), to which a single terminal metacryloyloxy group, vinyl group or mercapto group has been added, and at least one monomer such as alkyl (meth)acrylate, (meth)acrylic acid, (meth)acrylic acid derivatives possessing functional groups, vinyl acetate, vinyl chloride, (meth)acrylonitrile, styrene and the like; graft polymers obtained from the reaction of a dicarboxylic acid and a diol with a macromonomer, possessing two hydroxyl or carboxyl groups near the polysiloxane end; and graft polymers obtained from the reaction of a diepoxy or a diisocyanate compound with a macromonomer possessing two hydroxyl or carboxyl groups near the polysiloxane end.

As the graft polymer possessing polyorganosiloxane in the main stem or in a branch, there can be mentioned graft polymers having polyorganosiloxane in the main stem, and polymers or copolymers obtained from vinyl polymerization, condensation polymerization, ring-opening polymerization, and the like, in a branch. As specific examples of these graft polymers there can be mentioned graft polymers obtained from the polymerization of a polysiloxane with a methacryloyloxy group in its side chain, synthesized by the condensation of silane possessing organosilane and vinyl polymerizable groups such as 3-methacryloylxypropyldimethoxymethylsilane, methylvinyldimethoxysilane, ethylvinyldiethoxysilane, and the like, and at least one monomer such as alkyl (meth)acrylate, (meth)acrylic acid, (meth)acrylic acid derivatives possessing functional groups, vinyl acetate, vinyl chloride, (meth)acrylonitrile, styrene and the like; graft polymers obtained from the polymerization of a monomer possessing a (meth)acryloyloxy group which was obtained through the reaction of (meth)acrylic acid and a polysiloxane possessing a glycidyl group in its side chain, synthesized by the condensation of organosilane and diethoxy-3-glycidoxypropylmethylsilane; and graft polymers obtained by polycondensation of a dicarboxylic acid and a polysiloxane possessing a hydroxyl group in its side chain, synthesized by polycondensation of organosilane and hydroxyethylmethyl-dimethoxysilane.

When synthesizing a polysiloxane to be incorporated into the main stem or a branch of the graft polymer, it is best to perform the polymerization at a temperature of 70°~150° C. using a cyclic silane as the main raw material, in particular a cyclic dimethylpolysiloxane with 3~8 repeating units, and a silane compound as the molecular weight modifier such as a trimethylmethoxysilane or a trimethylethoxysilane with one alkoxy group per molecule, and reacting this cyclic silane and a silane compound with a silane possessing a functional group under strong acid or strong base catalyst.

By incorporating these graft polymers into the image-receiving layer, both the anti blocking property to a transfer sheet and the dark color fastness of the dyed image-receiving layer are improved. The graft polymer is incorporated in an amount of 0.01 to 30 parts by weight, preferably 0.05 to 10 parts by weight, per 100 parts by weight of the total amount of the dyeable polyester resin and the crosslinking agent. If the amount incorporated is less than 0.01 parts by weight, improvement of the anti-blocking property as well as the dark color fastness is reduced, and if the amount exceeds 30 parts by weight, the image-receiving layer becomes opaque and the dyeing density is degraded.

In view of the dark color fastness, it is preferred that a compound with a molecular weight of 1000 or greater be used as polyorganosiloxane containing graft polymer. Additionally, the weight ratio of the polyorganosiloxane component to polymers other than polyorganosiloxane or copolymers (polyorganosiloxane/-polymer or copolymer) is from 95/5 to 10/90, preferably from 90/10 to 20/80. If this ratio exceeds 95/5, there is a tendency for the dark color fastness to be degraded, and if the ratio is less than 10/90, there is a tendency for both the anti blocking property as well as the dark color fastness to be degraded.

As the crosslinkable type or active energy ray crosslinkable-type releasing agent possessing a silicon or fluorine-containing crosslinked structure, there can be mentioned silicon-containing compounds such as those formed by addition reaction, radical reaction and condensation reaction. As silicon-containing compounds formed by addition reaction, there can be mentioned combinations such as that of a vinyl group containing silicon and a —SiH group containing silicon, and that of an amine-modified silicon and an epoxy-modified silicon, in which platinum compound catalysts and the like can be used as necessary. As silicon-containing compounds formed by radical reaction, there can be mentioned combinations such as that of a vinyl group containing silicon and a methylsilane containing silicon, in which organic peroxide compounds can be used as the polymerization initiator. As silicon-containing compounds formed by condensation reaction, there can be mentioned combinations such as that of a alkoxy group containing silicon, a silanol group containing silicon and a silicon containing both an alkoxyl group containing silicon and a silanol group; a silanol group containing silicon and a —SiH group containing silicon; and a silanol group containing silicon and an aminoxyl group containing silicon.

As fluorine-containing compounds formed by addition reaction, there can be mentioned combinations such as that of an epoxy group containing fluorine compound and an amino group containing fluorine compound, while as fluorine-containing compounds formed by condensation reaction there can be mentioned combinations such as that of a carboxylic acid containing fluorine compound and an amino group containing fluorine compound.

In order for these silicon-containing compounds and fluorine-containing compounds to acquire a sufficient crosslinked structure, it is necessary that there be at least two functional groups for every molecule present; when there is less than two functional groups for every molecule present, even though a polymer may be obtained, the polymer does not acquire a sufficient crosslinking structure.

As the active energy ray crosslinkable-type silicon or fluorine-containing compound, there can be mentioned compounds possessing a radical polymerizable group such as a vinyl group, an aryl group, a methacryloyl group, an acryloyl group and the like. When ultraviolet rays are used as the active energy ray, compounds possessing acryloyloxy groups easily polymerizable using ultraviolet rays are preferred In order for these active energy ray crosslinkable type compounds to acquire a sufficient crosslinked structure, it is necessary that there be at least one polymerizable group for every molecule present.

In the present invention, when curing the resin composition to form the image-receiving layer using active energy rays, an active energy ray crosslinkable-type releasing agent, when employed, can be cured at the same time; however, when using a thermosetting releasing agent, it becomes necessary to add a thermosetting process separate from the curing of the resin composition. Consequently, when curing the resin composition to form the image-receiving layer with active energy rays, from a productivity standpoint, it is preferred that an active energy ray crosslinkable-type releasing agent be used.

The anthraquinone based bluing agent is the most important image receiving layer component in the present invention. By adding it to the image-receiving layer, the recording media formed exhibits a whiteness with a slight green tinge, and the recording media comes to exhibit a high grade image such as that of silver salt photo print paper. Additionally, with the addition of the bluing agent, many of the problems associated with the aforementioned addition of white pigment and fluorescent whitening agent are not generated.

As specific examples of the anthraquinone bluing agent, there can be mentioned in accordance with the color index classification, Solvent Violet-33, Solvent Blue-94, Solvent Blue-78, Solvent Blue-95, Solvent Violet-13 and the like.

However, when curing the image-receiving layer with active energy rays, a problem occured in that the cured image-receiving layer turned yellow due to the bluing agent. After carrying out intensive research, it was found that when using a special bluing agent, the image-receiving layer did not turn yellow even when curing with active energy rays, and a recording media with a high whiteness degree was obtained. At least one member chosen from the group consisting of, in accordance with the color index classification, Solvent Violet 33, Solvent Blue-94, Solvent Blue-78 and Solvent Blue 95 can be used as specific examples of this special bluing agent.

All of the above mentioned bluing agents are anthraquinone based dyes, however, it is not the case that any anthraquinone based dye may be used as the bluing agent. Only when using the above mentioned dyes did the recording media not turn yellow during curing with active energy rays, resulting in the production of a recording media for a sublimation-type heat sensitive recording process possessing a high whiteness degree.

For example, when a similar anthraquinone based bluing agent Solvent Violet-13 was used, following curing with active energy rays, the image receiving layer turned yellow, exhibiting degradation of the whiteness degree. Thus, when curing the image receiving layer with active energy rays, it is especially preferred that the above mentioned special bluing agents be used It is preferred that the bluing agent be added at an optimal amount of 0.0001 to 0.1 parts by weight per 100 parts by weight of the total amount of the dyeable resin and the crosslinking agent. If the amount added is less than 0.0001 parts by weight, improvement of the whiteness degree does not occur, however, if the amount added exceeds 0.1 parts by weight, the image-receiving layer turns excessively green, which is also undesirable. Thus the most preferred range is 0.001 to 0.01 parts by weight.

In order to improve the light stability of the recording media dyed with the sublimable dye, it is preferred that an ultraviolet absorber be incorporated into the image-receiving layer. As ultraviolet absorbers, benzophenone ultraviolet absorbers and benzotriazole absorbers are generally known. Among these ultraviolet absorbers, taking into serious consideration the whiteness degree of the recording media, it is especially preferred that at least one benzophenone ultraviolet absorber be chosen from the group defined by general formulae (1) and (2) below.

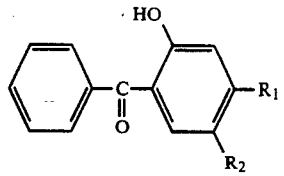

(1)

$R_1$: —OH, —$OR_3$
$R_2$ —H, $SO_3H$
$R_3$; $C_1$–$C_{10}$ alkyl group

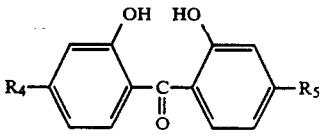

(2)

$R_4$: —$OR_6$
$R_5$: —$OR_7$
$R_6$: $C_1$–$C_{10}$ alkyl group
$R_7$: $C_1$–$C_{10}$ alkyl group As specific examples of the benzophenone ultraviolet absorbers described by general formulae (1) and (2), there can be mentioned 2,4-dihydroxybenzophenone, 2-hydroxy-4-methoxybenzophenone, 2-hydroxy 4 octoxybenzophenone, 2-hydroxy-4-dodecyloxybenzophenone, 2,2'-dihydroxy-4,4'-dimethoxybenzophenone, 2,2'-dihydroxy-4,4'-didodecyloxybenzophenone and the like.

However, when using ultraviolet absorbers other than those mentioned above, for example 2,2',4,4'-tetrahydroxybenzophenone and benzotriazole ultraviolet absorbers, the recording media turns yellow, an undesirable result.

The amount of the aforementioned ultraviolet absorbers incorporated is 1 to 10 parts by weight per 100 parts by weight of the dyeable resin and the crosslinking agent. If the amount incorporated is less than 1 part by weight, there is insufficient light stability, while if the amount incorporated exceeds 10 parts by weight, the curability is degraded when curing with active energy rays. Thus the preferred range is 2 to 8 parts by weight.

Additionally, in order to further improve the light stability of the recording media following recording, it is preferred that a hindered amine photostabilizer be used jointly with the above mentioned ultraviolet absorber.

As the hindered amine photostabilizer, there can be mentioned bis(2,2,6,6-tetramethyl-4-piperidyl)sebacate (Sanol ®LS770 supplied by Sankyo Company, Limited), bis(1,2,2,6,6-pentamethyl-4-piperidyl)sebacate (Sanol ®LS292 supplied by Sankyo Company, Limited), dimethyl succinate/1-(2-hydroxyethyl) 4 hydroxy-2,2,6,6-tetramethylpiperidine polycondensate (Tinuvin ®22 LD supplied by Ciba-Geigy), poly{[6-(1,1,3,3-tetramethylbutyl)amino-1,3,5-triazin-2,4-diyl][2,2,6,6-tetramethyl-4-piperidyl)imino]hexamethylene[(2,2,6,6-tetramethy-4-piperidyl)imino]} (Chimassorb ®944LD supplied by Ciba-Geigy) and 1-(2-[3-(3,5-di-tert-butyl-4-hydroxyphenyl)propionyloxy]ethyl}-4-[3-(3,5-di-tert-butyl-4-hydroxyphenyl)propionyloxy]-2,2,6,6-tetramethylpiperidine (Sanol ®LS2626 supplied by Sankyo Company, Limited).

At least one member selected from these hindered amine photostabilizers is incorporated in an amount of 1 to 10 parts by weight per 100 parts by weight of the total amount of the dyeable resin and the crosslinking agent. If the amount of the photostabilizer is smaller than 1 part by weight, the effect of improving the color density, the light stability and the dark color fastness is insufficient. If the amount of photostabilizer is greater than 10 parts by weight, the curability by active energy rays is degraded.

Where a compound having a high polymer solubility and a low viscosity, such as tetrahydrofurfuryl acrylate, is used as a component of the crosslinking agent, the resin composition comprising the above mentioned components can be directly coated by roll coating, bar coating or blade coating. However, in order to improve the adaptability to the coating operation, preferably a solvent such as ethyl alcohol, methyl ethyl ketone, toluene, ethyl acetate or dimethylformamide is incorporated to adjust the viscosity to an adequate level. In this case, the composition can be easily coated by spray coating, curtain coating, flow coating or dip coating.

Additionally, fine inorganic particles having a particle size smaller than several μm, such as those of silica, alumina, talc and titanium oxide, may be incorporated in the resin composition in accordance with usage objectives.

When curing the resin composition used to manufacture the recording media of the present invention by active energy rays such as electron rays and ultraviolet rays, in view of the control of the active energy ray source, the use of ultraviolet rays is preferred. When ultraviolet rays are used as the active energy rays, preferably a photopolymerization initiator is incorporated in the composition in an amount of 0.1 to 10.0 parts by weight per 100 parts by weight of the total amount of the dyeable resin and the crosslinking agent.

As specific examples of the photopolymerization initiator, there can be mentioned carbonyl compounds such as carbonyl compounds such as benzoin, benzoin isobutyl ether, benzyldimethylketal, ethylphenyl glyoxylate, diethoxyacetophenone, 1,1-dichloroacetophenone, 4'-isopropyl-2-hydroxy-2-methylpropiophenone, 1-hydroxycyclohexyl-phenylketone, benzophenone, benzophenone/diethanolamine, 4,4'-bisdimethylamino-benzophenone, 2-methylthioxanthone, tert-butylanthraquinone and benzyl; sulfur compounds such as teLramethylthiuram monosulfide and tetramethylthiuram disulfide; azo compounds such as azobisisobutylonitrile and azobis-2,4-dimethylvaleronitrile; and peroxides such as benzoyl peroxide and di-tert-butyl peroxide. These compounds can be used singly or in the form of mixture of two or more thereof.

Film or paper substrates are suitable as the substrate for the production of the recording media. For example, there can be mentioned plastic films such as a polyester film, a polypropylene film, a nylon film and a polyvinyl chloride film; papers composed mainly of wood fibers, such as a coat paper, a baryta paper and an art paper; and papers composed mainly of plastic fibers, such as an acrylic paper, a polypropylene paper, a polyester paper and a laminate paper formed by laminating either plastic film or synthesized paper to one or both sides of ordinary paper.

The paper or film may be directly used, or the paper or film may be subjected to a preliminary treatment such as washing, etching, corona discharge, irradiation with active energy rays, dyeing or printing according to need, before actual use.

The sublimable dye-dyeable composition is uniformly coated on the above mentioned substrate according to the coating method as described above so that the thickness after curing is 0.5 to 100 μm, preferably 1 to 50 μm. If the thickness is smaller than 0 5 μm, diffusion of the sublimable dye becomes saturated at the midway point and the substrate cannot be dyed at a high density. However, if the thickness is larger than 100 μm, blocking is often caused at the heating step.

Where it is necessary to store dyed articles in the piled state for a long time, in order to prevent the migration of the sublimable dye, preferably the above mentioned resin composition is coated only on one surface of the substrate. However, to effectively prevent migration of the sublimable dye, it is especially preferable to form a non migration layer on the surface opposite to the surface coated with the sublimable dye-dyeable composition.

As the composition for forming the non-migration layer, a coating material comprising 100 parts by weight of a monomer or oligomer mixture comprising the above mentioned polyfunctional monomer and/or monofunctional monomer and, if necessary, 0 1 to 100 parts by weight of the above mentioned photopolymerization initiator can be used. In order to completely prevent the migration of the sublimable dye, the average number of polymerizable groups in the monomer or oligomer mixture must be at least 1.5 per molecule. In regards to this coating material, adjustment of the viscosity by a solvent, coating on the substrate and curing can be performed in the same manner as described above with respect to the sublimable dye-dyeable composition.

The present invention will now be described in detail with reference to the following examples. Note, all of the "parts" in the examples and comparative examples are by weight.

(A) Substrate formation

An milky colored polyester film (W-900 supplied by Diafoil) having a thickness of 38 μm was laminated onto one side of an art paper (thickness 85 μm), and a white polypropylene paper (UpoFPG supplied by Ojiyuka) having a thickness of 60 μm was laminated onto the opposite side of the same art paper. The adhesive agents used were AD-577-1 and CAT-52 supplied by Toyo Moton, and the coating amount between the milky polyester film and the coat paper was 5 g/m$^2$ and between the coat paper and the white polypropylene paper when dry was 3 g/m$^2$. Drying was carried out at 80° C. for 30 seconds, and edging was performed for 2 days at 40° C.

(B) Formation of the image-receiving layer

The coating fluid shown in table 1 was prepared and was uniformly coated onto the surface of the polyester film of the substrate according to a dipping method, and the solvent was removed by evaporation The coated film was then irradiated with ultraviolet rays from a high pressure mercury lamp in air to obtain an image-receiving layer having a thickness of 5 to 6 μm The evaluation results are shown in table 2.

The "notes" section of table 1 represents the following:

1) Dipentaerythritol hexa-acrylate
2) Dipentaerythritol penta-acrylate
3) Dipentaerythritol tetra-acrylate 4) 2,2-bis(4-acryloyloxydiethoxyphenyl)propane
5) Resin obtained by polycondensation of terephthalic acid, isophthalic acid and sebacic acid with ethylene glycol and neopentyl glycol (molecular weight=20,000 to 25,000, Tg 10° C.)
6) Resin obtained by polycondensation of terephthalic acid, isophthalic acid and sebacic acid with ethylene glycol and the ethyleneoxide adduct of bisphenol A (molecular weight=20,000 to 25,000, Tg 77° C.)
7) 1-Hydroxycyclohexyl phenyl ketone
8) Sanol ®LS-292 (supplied by Sankyo Company, Limited)
9) Silicon-containing compound described by the following chemical formula (10):

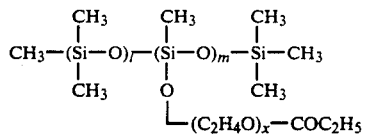

(10)

$$\frac{21 + m + 1}{m \times x} = 1.3$$

10) 2,4-Dihydroxybenzophenone
11) 2-Hydroxy-4-octoxybenzophenone
12) 2-Hydroxy-4-methoxybenzophenone-5-sulfonic acid
13) 2,2'-Dihydroxy-4,4'-dimethoxybenzophenone
14) 2,2',4,4'-Tetrahydroxybenzophenone
15) 2-(2'-Hydroxy-3',5'-di-t-butylphenyl)benzotriazole
16) Solvent Violet-33
17) Solvent Blue-94
18) Solvent Blue-78
19) Solvent Blue-95
20) Solvent Violet 13
21) UB Textile OB (supplied by Ciba-Geigy)

Evaluation of the whiteness degree in table 2 was made under sunlight by visual observation. In addition, "medium energy" refers to an irradiation energy amount of 600 mJ/cm$^2$, and "high energy" refers to an irradiation energy amount of 780 mJ/cm$^2$.

TABLE 1

| Component of | Examples | | | | Comparative Examples | | | | | | | |
|---|---|---|---|---|---|---|---|---|---|---|---|---|
| Coating Fluid | 1 | 2 | 3 | 4 | 1 | 2 | 3 | 4 | 5 | 6 | 7 | 8 |
| 2P6A[1] | | 3 | | | | | | | 3 | | | |
| 2P5A[2] | | 4 | | | | | | | 4 | | | |
| 2P4A[3] | | 3 | | | | | | | 3 | | | |
| A-DEP[4] | | 10 | | | | | | | 10 | | | |
| Resin A[5] | | 40 | | | | | | | 40 | | | |
| Resin B[6] | | 40 | | | | | | | 40 | | | |
| [PI][7] | | 5 | | | | | | | 5 | | | |
| [PS][8] | | 3 | | | | | | | 3 | | | |
| [RA][9] | | 0.1 | | | | | | | 0.1 | | | |
| [BP] A[10] | | | | | 3 | | | | | | | |
| [BP] B[11] | 3 | 3 | 3 | 3 | | 3 | | | | | 3 | 3 |
| [BP] C[12] | | | | | | | 3 | | | | | |
| [BP] D[13] | | | | | | | | 3 | | | | |
| [BP] E[14] | | | | | | | | | 3 | | | |
| [BT][15] | | | | | | | | | | 3 | | |
| [BA] A[16] | 0.005 | | | | | | | | | | | |
| [BA] B[17] | | 0.005 | | | | | | | 0.005 | 0.005 | | |
| [BA] C[18] | | | 0.005 | | | | | | | | | |
| [BA] D[19] | | | | 0.005 | | | | | | | | |
| [BA] E[20] | | | | | | | | | | | 0.005 | |
| [WA][21] | | | | | | | | | | | | 1.0 |
| [MEK] | | 600 | | | | | | | 600 | | | |
| Toluene | | 150 | | | | | | | 150 | | | |

Abbreviations:
[PI] = Photopolymerization initiator
[PS] = Photostabilizer
[RA] = Releasing agent
[BP] = Benzophenone
[BT] = Benzotriazole
[BA] = Bluing agent
[WA] = Whitening agent
[MEK] = Methyl ethyl ketone

TABLE 2

| | Whiteness Degree (by Visual Observation) | |
|---|---|---|
| | Medium Energy | High Energy |
| Example | | |
| 1 | A | A |
| 2 | A | A |
| 3 | A | A |
| 4 | A | A |
| Comparative Example | | |
| 1 | A | A⁻ |
| 2 | A | A⁻ |
| 3 | A | A⁻ |
| 4 | A | A⁻ |
| 5 | C | C |
| 6 | B | B |
| 7 | B | C |
| 8 | C | C |

Whiteness degree: A > A⁻ > B > C
A: High whiteness degree
B: Slightly yellow
C: Yellow

What is claimed is:

1. A recording medium for a sublimation heat-sensitive transfer recording process comprising an image receiving layer comprising a dyeable resin which is able to be colored by a sublimable dye; a crosslinking agent; at least one anthraquinone based bluing agent selected from the group consisting of Solvent Violet-33, Solvent Blue-94, Solvent Blue-78 and Solvent Blue-95; and a benzophenone based ultraviolet absorber selected from the group consisting of at least one compound of the formulae (1) and (2):

(1)

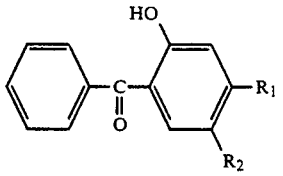

$R_1$: —OH, —$OR_3$
$R_2$: —H, —$SO_3H$
$R_3$: $C_1$-$C_0$ alkyl group (2)

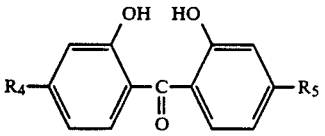

$R_4$: —$OR_6$
$R_5$: —$OR_7$
$R_6$: $C_1$-$C_{10}$ alkyl group
$R_7$; $C_1$-$C_{10}$ alkyl group

2. A recording medium for a sublimation heat-sensitive transfer recording process according to claim 1, wherein said crosslinking agent is curable by irradiation by an active energy ray.

3. A recording medium for a sublimation heat-sensitive transfer recording process according to claim 1, wherein said dyeable resin which is able to be colored by a sublimable dye is a polyester resin.

4. A recording medium for a sublimation heat-sensitive transfer recording process according to claim 1, wherein said image receiving layer further comprises at least one hindered amine photostabilizer and at least one releasing agent.

5. A recording medium for a sublimation heat-sensitive transfer recording process comprising an image receiving layer, provided on a surface of a substrate, said image receiving layer being prepared by curing a resin composition coat comprising 100 parts by weight of a mixture composed of 40 to 95% by weight of a polyester resin and 5 to 60% of a crosslinking agent, 0.01 to 30 parts by weight of at least one releasing agent, 1 to 10 parts by weight of at least one benzophenone based ultraviolet absorber, 1 to 10 parts by weight of at least one hindered amine photostabilizer and 0.0001 to 0.1 parts by weight of an anthraquinone based bluing agent, wherein said anthraquinone based bluing agent comprises at least one color selected from the group consisting of Solvent Violet-33, Solvent Blue-94, Solvent Blue-78 and Solvent Blue-95, and wherein said benzophenone based ultraviolet absorber is selected from the group consisting of at least one compound of the formulae (1) and (2):

(1)

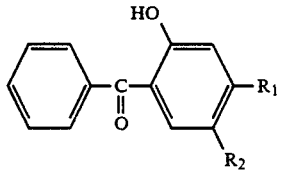

$R_1$: —OH, —$OR_3$
$R_2$: —H, —$SO_3H$
$R_3$: $C_1$-$C_{10}$ alkyl group (2)

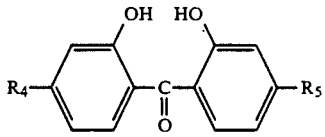

$R_4$: —$OR_6$
$R_5$: —$OR_7$
$R_6$: $C_1$-$C_{10}$ alkyl group
$R_7$: $C_1$-$C_{10}$ alkyl group

6. A recording medium for a sublimation heat-sensitive transfer recording process according to claim 5, wherein said crosslinking agent is curable by means of an active energy ray.

* * * * *